US007526886B2

(12) United States Patent
McClanahan et al.

(10) Patent No.: US 7,526,886 B2
(45) Date of Patent: May 5, 2009

(54) WEAR ASSEMBLY FOR AN EXCAVATING BUCKET

(75) Inventors: Robert McClanahan, Milwaukie, OR (US); Phil Metschan, Vancouver, WA (US); Carolyn Shapiro, Portland, OR (US)

(73) Assignee: Esco Corporation, Portland, OR (US)

( * ) Notice: Subject to any disclaimer, the term of this patent is extended or adjusted under 35 U.S.C. 154(b) by 80 days.

(21) Appl. No.: 11/877,033

(22) Filed: Oct. 23, 2007

(65) Prior Publication Data

US 2008/0092413 A1 Apr. 24, 2008

Related U.S. Application Data

(60) Provisional application No. 60/853,908, filed on Oct. 24, 2006.

(51) Int. Cl.
*E02F 9/28* (2006.01)

(52) U.S. Cl. ..... 37/457; 37/450; 37/455; 37/456

(58) Field of Classification Search ..... 37/450–460
See application file for complete search history.

(56) References Cited

U.S. PATENT DOCUMENTS 943,775 A * 12/1909 Exton et al. ..... 37/454
1,021,185 A * 3/1912 Foster ..... 5/289
1,787,695 A * 1/1931 McKee ..... 37/455
1,917,431 A * 7/1933 O'Fallon ..... 37/455
2,020,215 A * 11/1935 Ross ..... 299/103
2,547,789 A * 4/1951 Skeel ..... 403/370
3,032,152 A * 5/1962 Titsler ..... 403/374.3
3,722,932 A * 3/1973 Dougall ..... 403/379.4
4,372,703 A * 2/1983 Szostak ..... 403/324
4,380,102 A * 4/1983 Hansson ..... 24/459
5,311,681 A * 5/1994 Ruvang et al. ..... 37/457
5,331,754 A * 7/1994 Ruvang ..... 37/457
5,410,826 A * 5/1995 Immel et al. ..... 37/457
5,452,529 A * 9/1995 Neuenfeldt et al. ..... 37/455
5,465,512 A * 11/1995 Livesay et al. ..... 37/457
5,564,206 A * 10/1996 Ruvang ..... 37/458
5,638,621 A * 6/1997 Keech et al. ..... 37/446
5,653,048 A * 8/1997 Jones et al. ..... 37/452
5,784,813 A * 7/1998 Balassa et al. ..... 37/455
5,833,323 A * 11/1998 Massa et al. ..... 299/102
5,913,605 A * 6/1999 Jusselin et al. ..... 37/451
5,964,547 A * 10/1999 Brinkley ..... 403/374.3
6,009,644 A * 1/2000 Hedley ..... 37/456
6,108,950 A * 8/2000 Ruvang et al. ..... 37/452
6,145,224 A * 11/2000 Stickling ..... 37/458
6,301,810 B1 * 10/2001 Fidler ..... 37/458

(Continued)

*Primary Examiner*—Thomas A Beach
(74) *Attorney, Agent, or Firm*—Steven P. Schad

(57) ABSTRACT

A wear assembly for protecting the digging edge of a bucket which includes a wear member having a lock-receiving hole in one leg and an upstanding rib along the other leg. The rib extends axially along the leg to be received into a slot in a base fixed to the lip of the bucket. The rib has a rear end that engages the base to hold the rear end of the rib between the base and the lip. The wear member further includes an interior surface that has a front portion formed with a curve to wrap around the digging edge and a plurality of stabilizing surfaces. The lock has a latch and a threaded wedge received into the passage to move the latch to its holding position to maintain the lock in the assembly during use.

16 Claims, 14 Drawing Sheets

U.S. PATENT DOCUMENTS

| | | | | |
|---|---|---|---|---|
| 6,729,052 | B2 * | 5/2004 | Ollinger et al. | 37/452 |
| 6,848,203 | B2 * | 2/2005 | Hohmann et al. | 37/446 |
| 6,986,216 | B2 * | 1/2006 | Emrich et al. | 37/450 |
| 7,171,771 | B2 * | 2/2007 | Briscoe | 37/455 |
| 7,174,661 | B2 * | 2/2007 | Briscoe | 37/455 |
| 7,299,570 | B2 * | 11/2007 | Emrich et al. | 37/455 |
| 2004/0216334 | A1 * | 11/2004 | Emrich et al. | 37/452 |
| 2004/0216335 | A1 * | 11/2004 | Jones | 37/453 |
| 2004/0216336 | A1 * | 11/2004 | Briscoe | 37/455 |
| 2004/0221491 | A1 * | 11/2004 | Briscoe | 37/452 |
| 2006/0010726 | A1 * | 1/2006 | Emrich et al. | 37/456 |
| 2007/0137071 | A1 * | 6/2007 | McClanahan et al. | 37/452 |
| 2007/0137072 | A1 * | 6/2007 | Briscoe | 37/453 |
| 2007/0193075 | A1 * | 8/2007 | Carpenter | 37/452 |
| 2007/0227051 | A1 * | 10/2007 | Carpenter et al. | 37/452 |
| 2007/0293074 | A1 | 12/2007 | McClanahan | |
| 2008/0092412 | A1 * | 4/2008 | McClanahan et al. | 37/451 |

* cited by examiner

WEAR ASSEMBLY FOR AN EXCAVATING BUCKET

FIELD OF THE INVENTION

The present invention pertains to a wear assembly for protecting the digging edge of an excavating bucket or the like.

BACKGROUND OF THE INVENTION

Excavating buckets are typically subjected to harsh conditions. Wear members are usually provided to protect the digging edges from premature wear. Such wear members have taken many different forms. For example, wear members have been secured to the lip of a bucket through the use of Whisler-style locking arrangements such as used in U.S. Pat. No. 4,570,365. These locks, however, require through-holes to be formed in the lip and the use of large hammers to drive the wedges into place. Wear members have also been secured to a lip of a bucket by a T-shaped base and a hammerless lock such as disclosed in U.S. Pat. Nos. 5,088,214 and 7,080,470. While these systems offer improvements over past systems, improved stability, strength, manufacturability, and value in a wear assembly are desirable.

SUMMARY OF THE INVENTION

The present invention pertains to an improved wear assembly with a wear member for protecting the front digging edge of excavating equipment, which is highly stable, is strong, experiences reduced wear, is easy to use and manufacture, safe, streamlined, and involves less discarded material at the end of its life.

In one aspect of the invention, the wear assembly includes a replaceable wear member that includes a pair of legs to straddle the lip (or sides) of an excavating bucket. One of the legs is provided with a hole for receiving a lock to secure the wear member to the lip, while the other leg includes an upstanding rib along its inner surface. The rib extends axially rearward to be slidingly received into a slot of a base fixed to the lip for support.

In another aspect of the invention, one of the legs of the wear member includes a rib having a rear end formed with a support surface that is free of the leg and faces away from the other leg. The support surface engages a holding surface of the base so as to hold the rear end of the rib between the base and the lip (or side) for support under load.

In another aspect of the invention, the wear member includes an interior surface that faces and overlies the lip (or side) of the bucket. The interior surface has a front portion formed with a generally uniform curvature to wrap around the lip and a plurality of spaced apart stabilizing surfaces. The stabilizing surfaces extend generally parallel to the central axial plane of the lip for a unique combination of enhanced stability and reduced stress.

In another aspect of the invention, the wear member and the base are formed with a tongue and groove coupling wherein the base is formed with a central groove and the wear member with a central tongue to fit within the groove. The tongue and groove each includes cooperating rails to secure the wear member to the base. The groove opens forwardly through the front end of the base to receive the tongue. This construction provides a stable, secure, and strong connection between the components that is easy to use.

In one other aspect of the invention, the lock to secure the wear member to the bucket includes a body provided with a passage, a movable latch, and a wedge received into the passage to move the latch to its holding position to maintain the lock in the assembly during use.

In another aspect of the invention, the lock includes a threaded wedge which is received into the lock body to move a latch to a position to retain the lock in the assembly. The latch is movable between a retaining position where the latch prevents unwanted loss of the lock and a release position where the latch permits removal of the lock.

In one other aspect of the invention, a threaded wedge is provided with a resilient material that is compressed by the complementary threaded surface to resist loosening of the threaded wedge. In one preferred embodiment, the resilient material is a strip of an elastomer fixed within the helical groove of the threaded wedge.

DETAILED DESCRIPTION OF THE PREFERRED EMBODIMENTS

Figure 1:
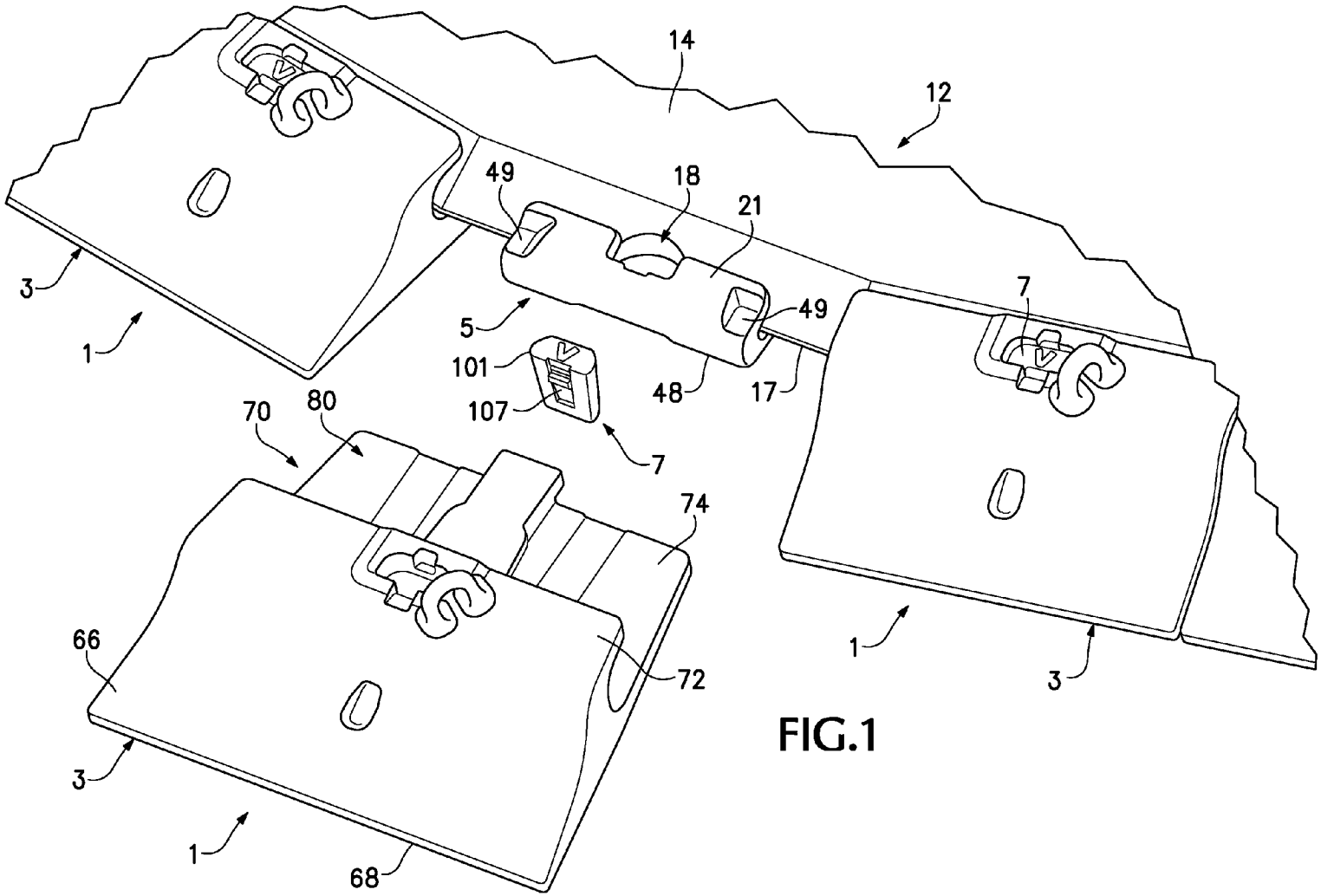
FIG. 1 is an exploded perspective view of a wear assembly in accordance with the present invention that is to be secured to a bucket lip.

In accordance with the present invention, a wear assembly 1 is provided for attachment to excavating equipment such as a bucket. The invention is discussed below in terms of the attachment of a shroud to the lip of a load-haul-dump (LHD) bucket. However, the invention is not limited to the attachment of a shroud or an LHD bucket. For example, the present invention could be used to secure shrouds to a different kind of bucket, mount shrouds between spaced apart teeth, and/or secure other kinds of wear members (e.g., wings or adapters). Although one kind of lip is illustrated in the drawings, the invention could be used with other kinds of lips having other formations and cross sections. Moreover, wings mounted along the sidewalls of the bucket adjacent the lip can have the same or similar construction. For purposes of this application the digging edge of the bucket will be deemed to include the front edges of the bucket sides where the wings are mounted as well as the front edge of the lip. Further, the invention is at times discussed in relative terms, such as up, down, front, rear, vertical, horizontal, etc., for the sake of easing the description. These terms are to be considered relative to the orientation of the elements in FIG. 1 (unless otherwise noted), and are not to be considered limitations on the invention. As can be appreciated, the wear assembly can be used and oriented in a variety of ways.

Figure 2:
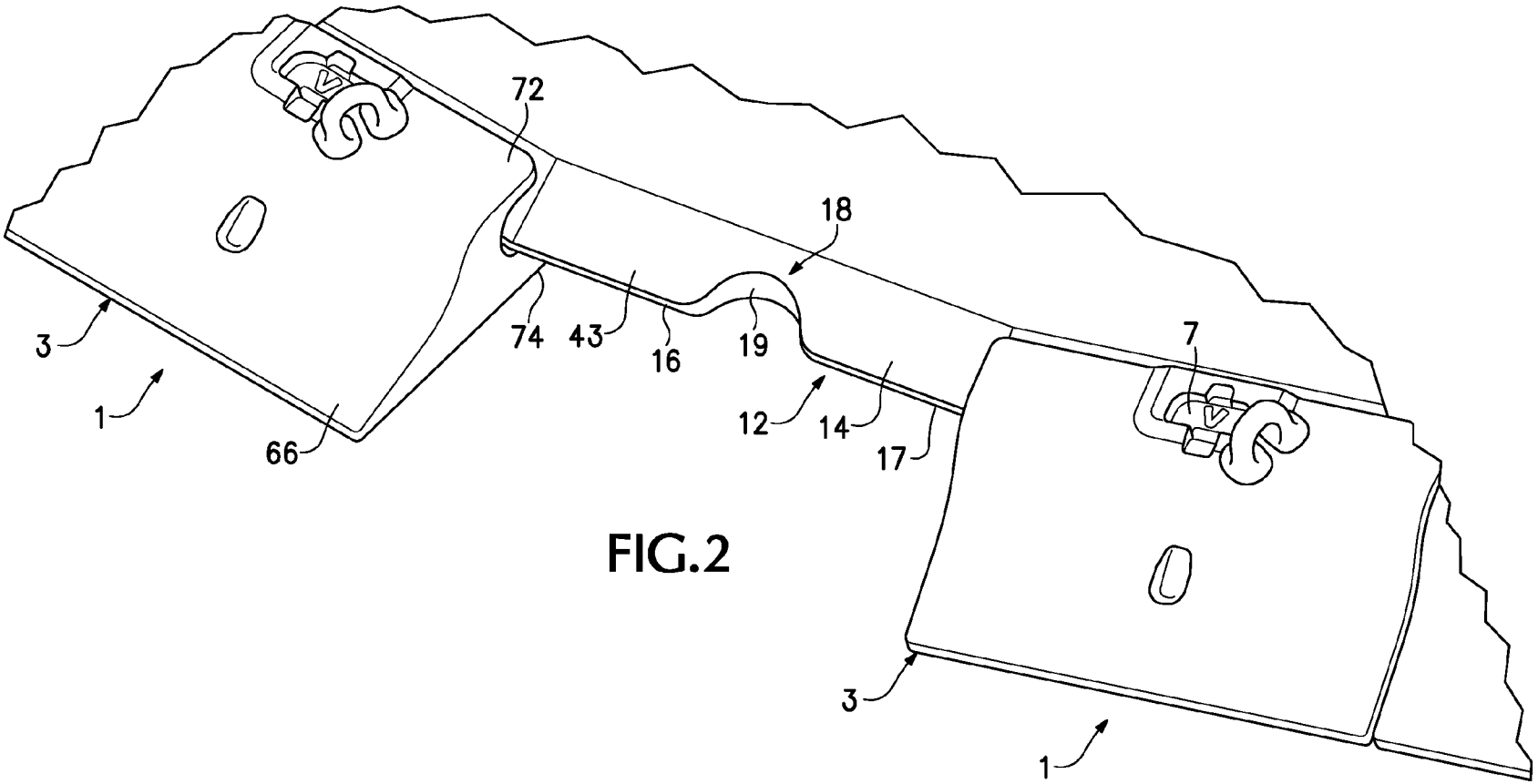
FIG. 2 is a partial, perspective view of a bucket lip where a wear assembly of the present invention has been omitted.
Figure 3:
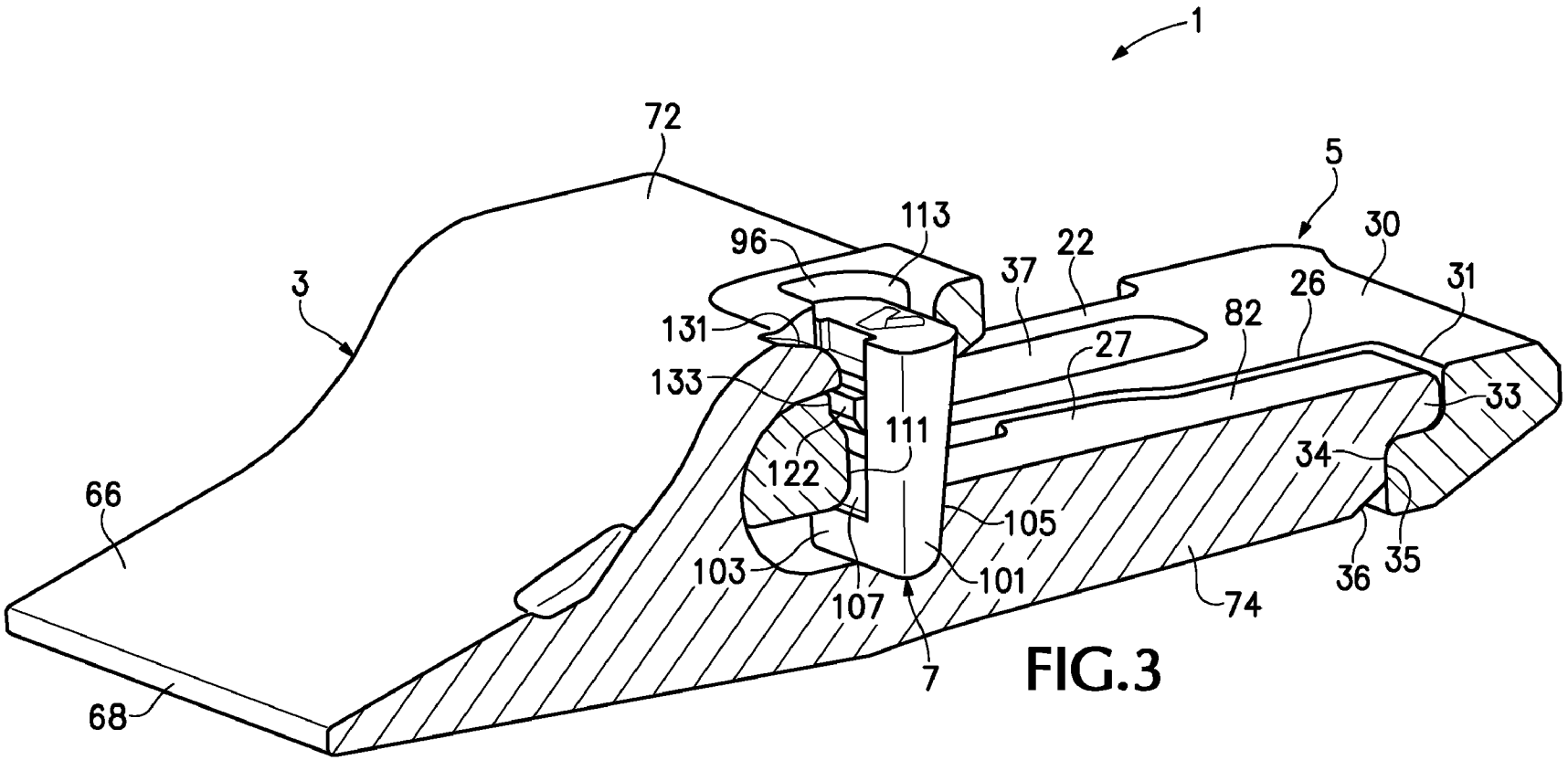
FIG. 3 a perspective view of the wear assembly with an axial cross section exposed.

Wear assembly 1 includes a wear member 3, a base 5, and a lock 7 to releasably secure the wear member (FIGS. 1 and 3). The wear assembly fits over and is secured to a lip 12 of a bucket or the like. Lip 12 includes an inside face 14, an outside face 16, and a front edge 17 (FIG. 2). Scallops or recesses 18 are preferably formed along the front edge 17 to accommodate passage of lock 7. Scallops 18 are each preferably formed to have a uniform, continual, arcuate surface 19 with a curvature that extends no more than about 180 degrees about an axis extending generally perpendicular to the lip to be easily manufactured and provide a robust base to resist the applied loads. Nevertheless, the scallops could be formed to have a non-uniform curvature, a discontinuous or angular shape, and/or be formed to have full or partial closure. In some circumstances, the scallops could be omitted with the boss extending farther forward from the lip.

A base 5 is fixed to lip 12 over each scallop 18 (FIG. 1). While bases 5 are preferably welded to the lip, they could be cast as an integral part of the lip or secured by mechanical means. In addition, the bases could each be formed as a multiple of parts, which are integral or spaced apart, although a one-piece member is preferred for simplicity and strength. Each base 5 has a pair of legs 21, 22 that straddle lip 12 (FIGS. 1 and 3-5). A first or inside leg 21 sets along inside surface 14 of lip 12 while a second or outside leg 22 sets along outside surface 16. Outside leg 22 is longer than inside leg 21 to interlock with base 5. However, the legs could be the same length or the inside leg longer. In addition, the base could have the opposite orientation with first leg 21 extending along outside face 16 and second leg 22 along inside face 14. Legs 21, 22 are interconnected by a front end 20.

Figure 4:
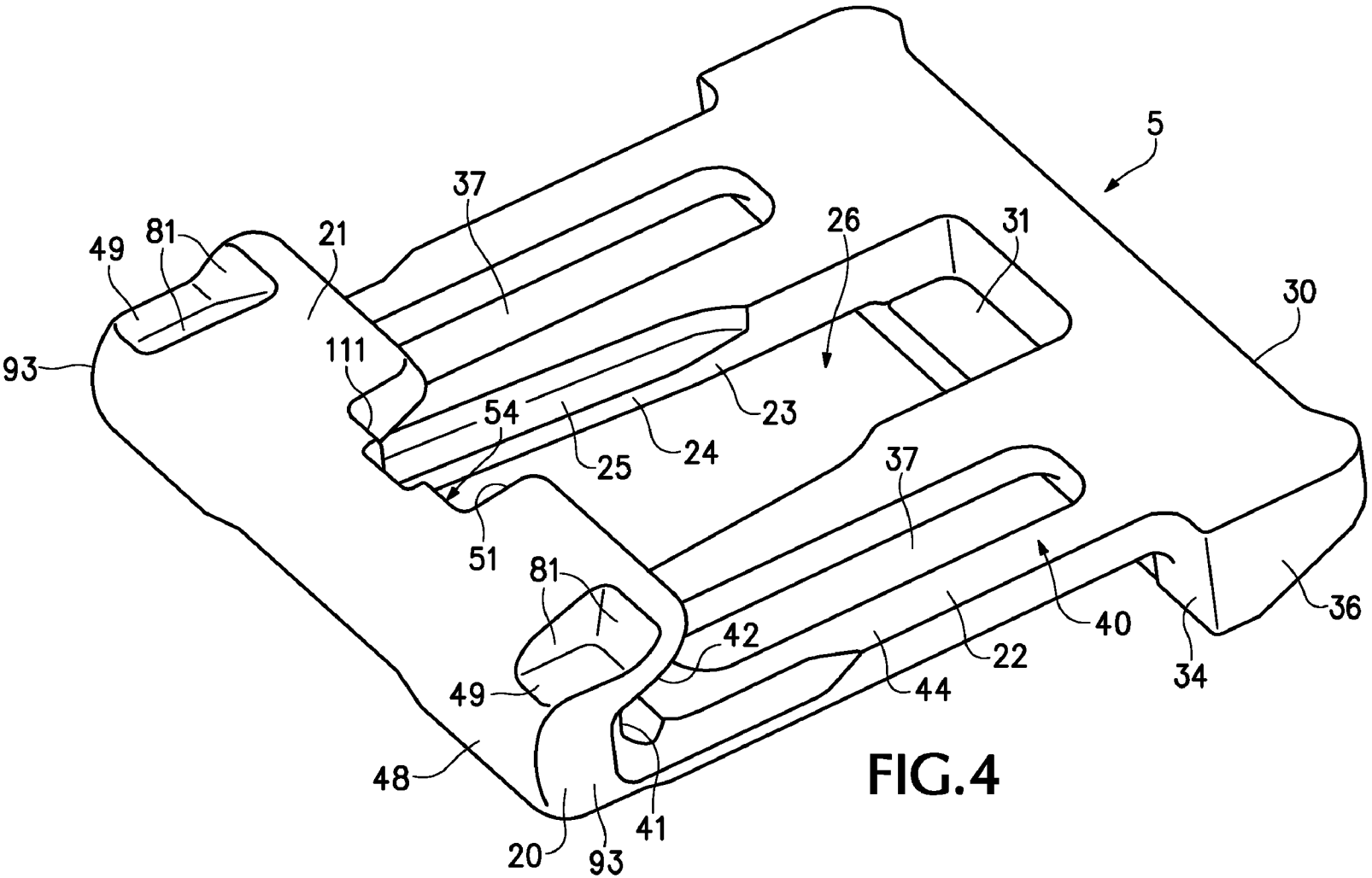
FIG. 4 is a top perspective view of a base of the wear assembly.

The second leg 22 includes a central, axial groove 26 provided with a pair of inwardly projecting rails 24 along its opposite sides 23 (FIG. 4). Rails 24 define holding surfaces 25 that are spaced from and facing outside face 16, Rails 24 cooperate with complementary rails 27 of wear member 3 to prevent the movement of leg 22 away from the lip. In some circumstances, for example, lower stress environments, the rails could be omitted entirely (not shown) so that the slot provides lateral support. A brace 30 is preferably provided at the rear end of second leg 22 (FIGS. 4 and 5), though it could be omitted. In this construction, groove 26 extends into brace 30 to define an opening 31, which is between brace 30 and outer wall 16 when the base is welded to lip 12. While a closed opening 31 is illustrated groove 26 could extend entirely through brace 30 to define an opening that is open on both ends. The opening could also be defined in leg 22 without the addition of the brace. In either case, opening 31 receives a support 33 of wear member 3 to strengthen and resist breakage of the wear member under heavy loading. Groove 26 also opens forwardly through the front end 20 of base 5 and is generally aligned with scallop 18.

Brace 30 also preferably extends transversely beyond leg 22 to define a front wall 34 to abut the rear end 35 of shroud 3 and thereby reduce the rearward shifting of the shroud under load, which in turn, reduces the stress and wearing of wear member 3 on base 5. Brace 30 also preferably has an equal or greater depth than leg 22 to maximize the surface area in abutment with shroud 3, and to function as a deflector for earthen material when the movement of the bucket is reversed. A deflector face 36 inclined forward from outer face 16 is preferably formed along the rear side of brace 30 to direct the earthen material away from the assembled base and shroud. Leg 22 is preferably formed as an open framework with openings 37 to reduce the amount of needed steel and to facilitate welding of the base to the lip.

The front end 20 of base 5 wraps around front edge 17 of lip 12 such that the interior surface 40 of the base (i.e., the surface that faces lip 12) is shaped to generally conform to the shape of the particular lip to which it is fixed (FIGS. 1, 4 and 5), although derivations are possible. In this case, interior surface 40 includes an upright face 41 to set against front edge 17, an upper face 42 to set against ramp 43 of inside face 14, and a lower face 44 to set against outside surface 16. If the front of the lip had a curved or other shape, interior surface 40 would be changed to accommodate the shape of the lip. The front end 20 of base 5 preferably has a curved front bearing surface 48 to minimize stress concentrations and wearing between the wear member and the base. In a preferred construction, front surface 48 has a generally uniform curvature, though other configurations are possible. A recess 51 is formed in first leg 21 in vertical alignment with groove 26 for receiving lock 7.

Figure 5:
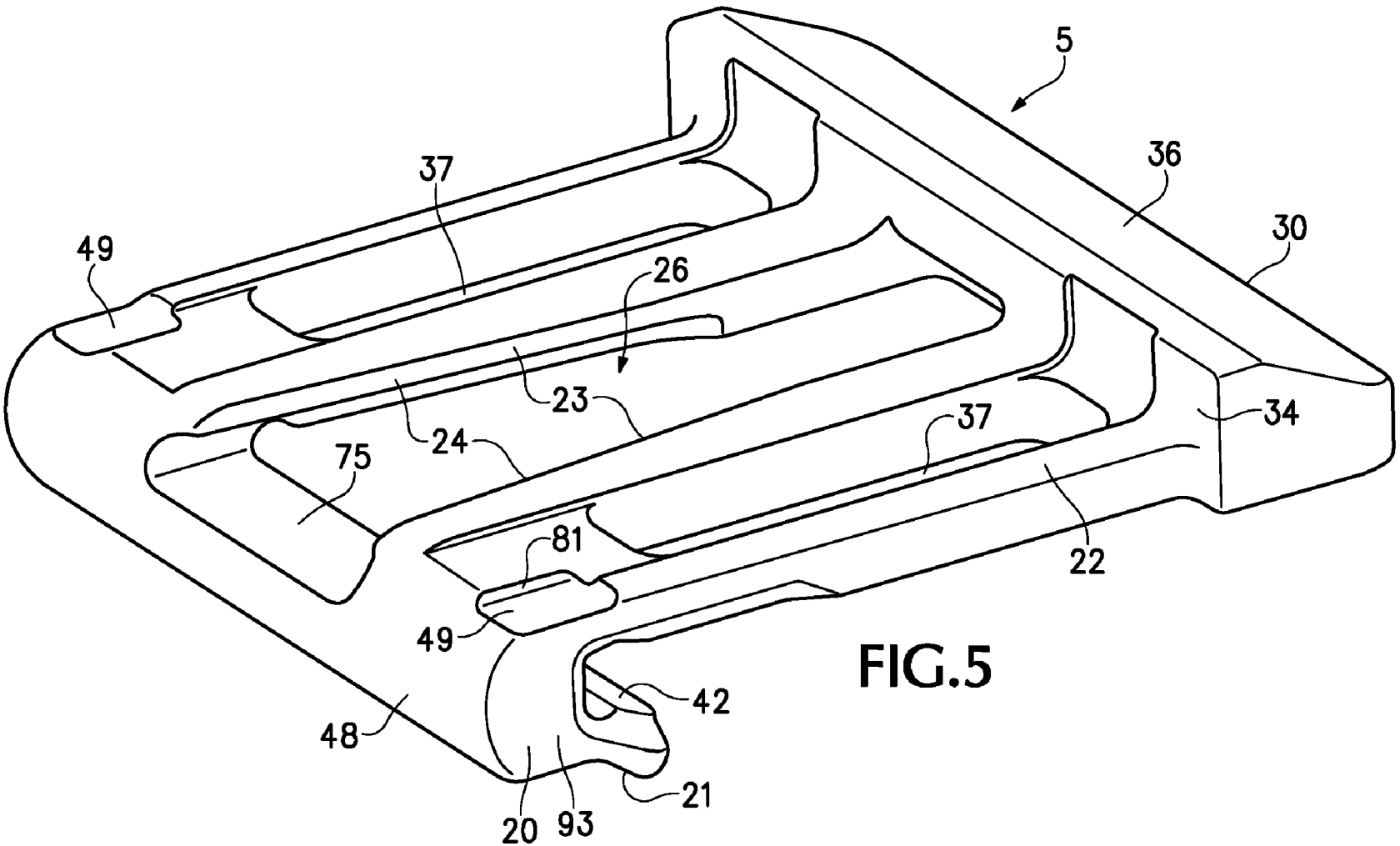
FIG. 5 is a bottom perspective view of the base.
Figure 6:
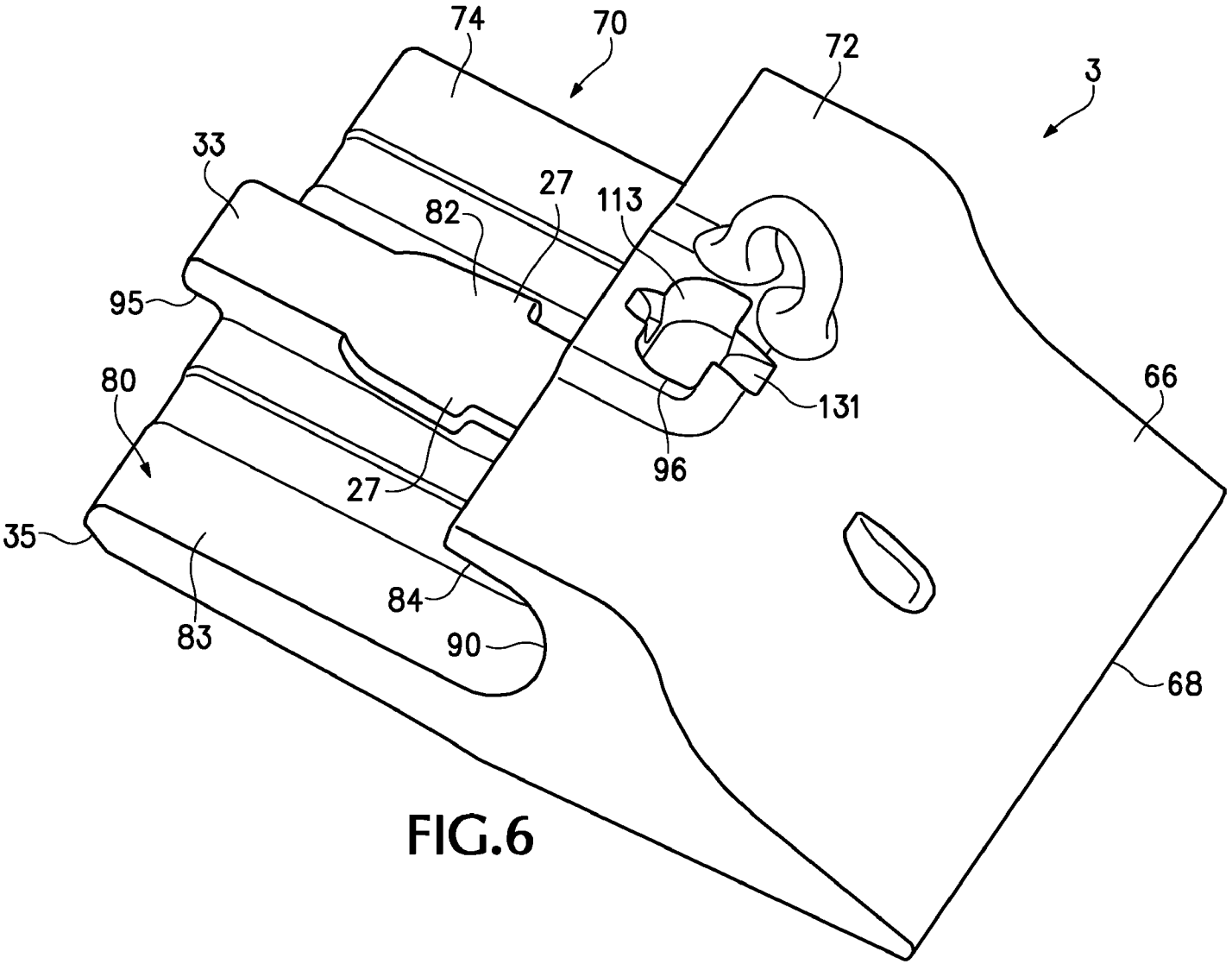
FIG. 6 is a front perspective view of a wear member of the wear assembly.
Figure 7:
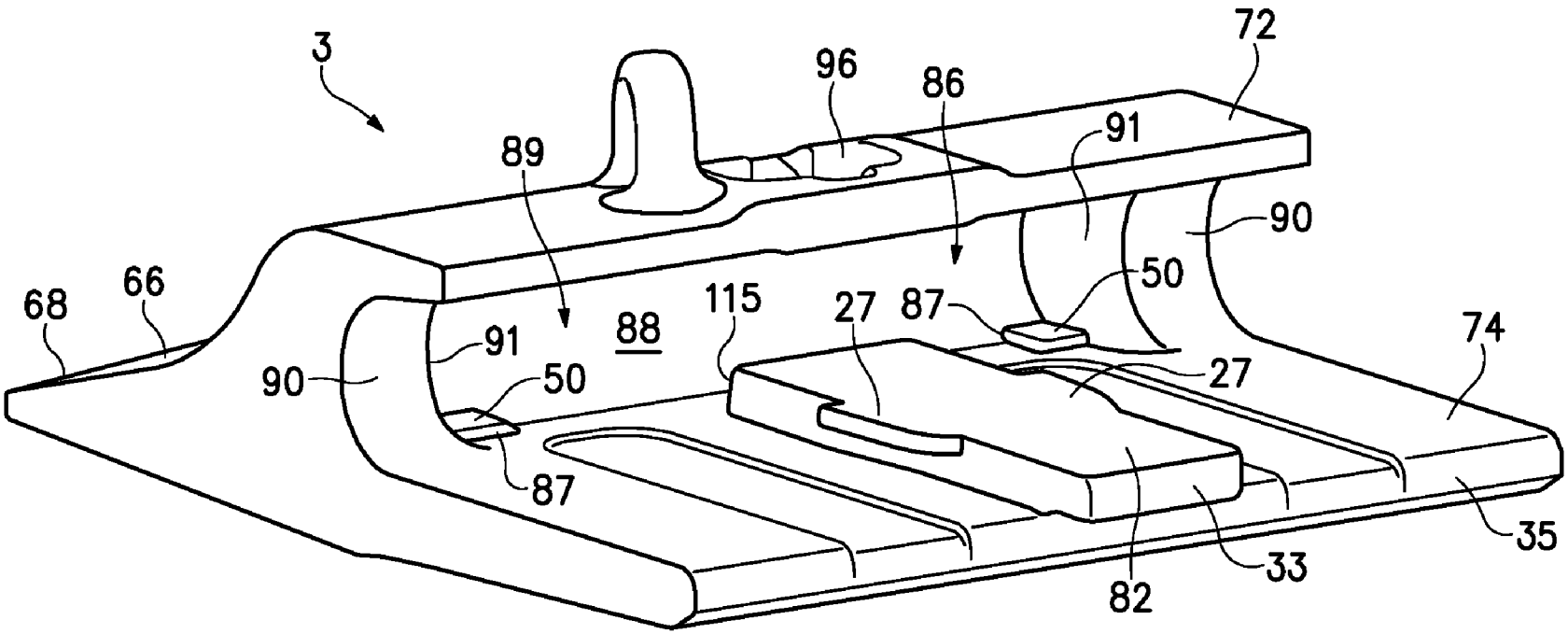
FIG. 7 is a rear perspective view of the wear member.
Figure 8:
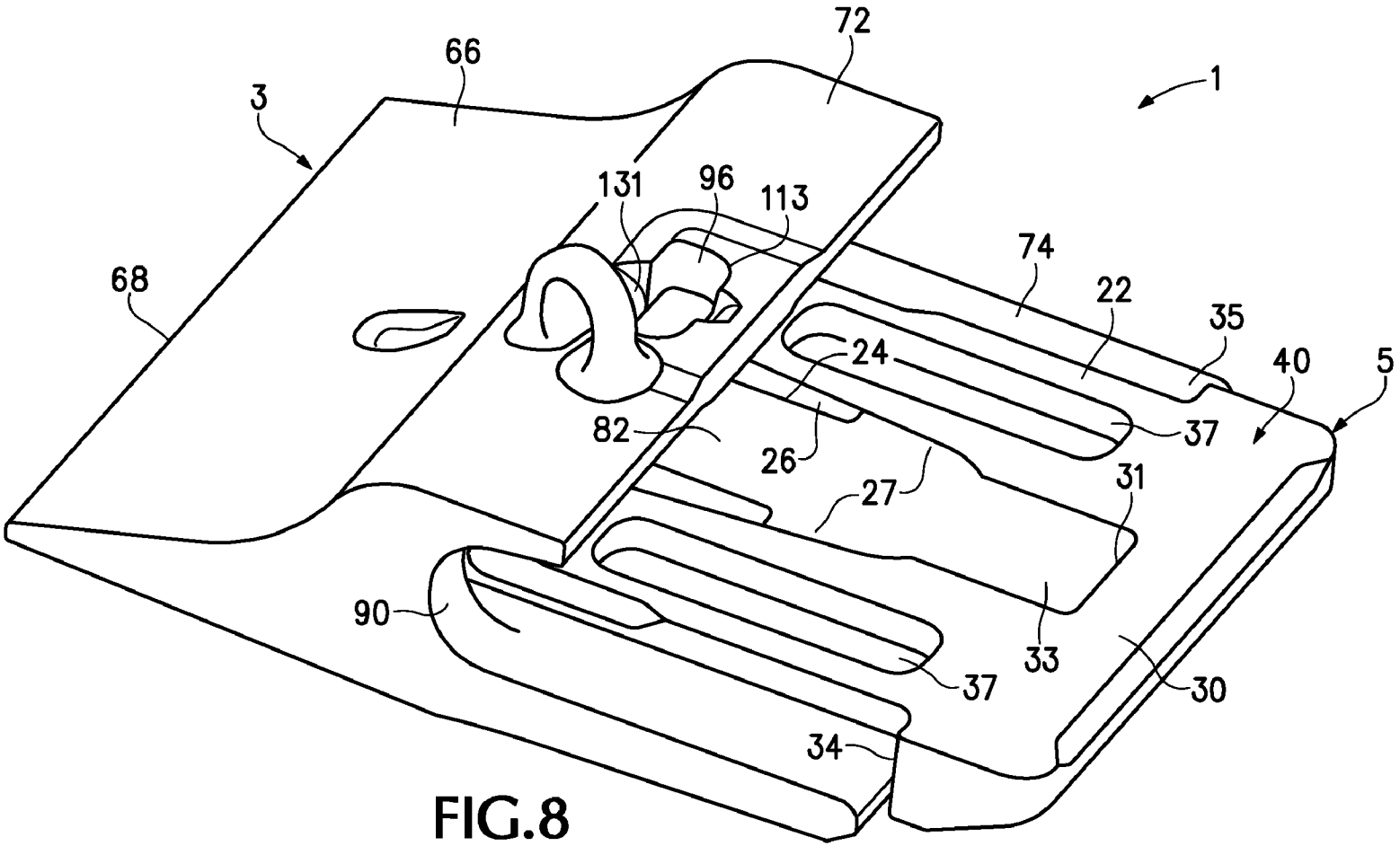
FIG. 8 is a perspective view of the assembled wear member and base.

Stabilizing surfaces 49 are formed in front end 20 proximate both legs 21, 22 to engage complementary stabilizing surfaces 50 on wear member 3 (FIGS. 1, 4 and 5). Stabilizing surfaces 49 are preferably limited in size so that front surface 48 is predominantly an uninterrupted generally uniform curved surface as it wraps around the front edge of the lip. The stabilizing surfaces are also preferably along the side 93 of base 5 for stability but could be provided at other locations. Also, the upper and lower stabilizing surfaces 49 are generally aligned vertically by each side 93 such that the upper and lower stabilizing surfaces 49 by the one side 93 are generally aligned with each other, and the upper and lower stabilizing 49 by the other side 93 are generally aligned—though other positions are possible. Stabilizing surfaces 49, 50 are preferably planar and horizontal, i.e., parallel to the central axial plane P of lip 12.

Wear member 3, which is a shroud in the illustrated construction, has a front working portion 66 that tapers to a narrowed front edge 68, and a rear mounting portion 70 that is bifurcated to define a first or inside leg 72 and a second or outside leg 74 (FIGS. 1, 3 and 6-8). The wear member is configured to set over base 5 with legs 72, 74 straddling lip 12. In a preferred construction, wear member 3 fits over lip 12 with first leg 72 overlying inside surface 14 and second leg 74 overlying outside surface 16. Nevertheless, the legs could be reversed so that first leg 72 is the outside leg and second leg 74 is the inside leg. Wear member 3 has an interior surface 80 that faces and overlies the lip. The interior surface 80 includes inner face 83 of outside leg 74. inner face 84 of inside leg 72, and the inner corner surface 86 at the intersection of legs 72, 74. Inner face 83 of leg 74 overlies leg 22 and outside face 16, and inside face 84 of leg 72 overlies leg 21 and inner face 14. Interior surface 80 along inner corner surface 86 has a central portion 88 and side portions 90. Central portion 88 generally matches front face 48 of base 5 and abuts against it during use. Central portion 88 is recessed relative to side portions 90 to form sidewalls 91 juxtaposed to sides 93 of base 5 for increased lateral support.

In a preferred construction, interior surface 80 along central portion 88 defines a curved bearing surface 85 (preferably having a generally uniform curve) that opposes and abuts front bearing surface 48. The lack of edges on the front bearing surfaces of the wear member and the base reduces stress concentrations in the parts, i.e., the generally uniform matching curvature of the two surfaces at the front bearing surface reduces the concentration of stress that can occur in the corners of other parts as the wear part tends to shift on the base during use.

At times, heavy vertical loads (i.e. the loads with vertical components) are applied to the front working end 66 of wear member 3. It is desirable to resist such loads with surfaces that are substantially horizontal, i.e., generally perpendicular to the vertical component of the load. In the present invention, a front end 89 of interior surface 80 forms the uniform curved surface 86 and a pair of stabilizing surfaces 50 (FIG. 7) proximate each of the legs 72, 74 and central portion 88 to engage stabilizing surfaces 49 on base 5 (FIGS. 4 and 5). The stabilizing surfaces 49, 50 provide better resistance and greater stability to wear member 3 under vertical loading. To avoid the creation of long edges, the stabilizing surfaces 49, 50 are limited to discrete locations, preferably extending only a small portion across the front ends of the wear member 3 and base 5 (collectively no more than half), and are preferably located at the sides of bearing surfaces 48, 86 for increased stability. In this way, the benefit gained by the curved bearing surfaces is not lost by the use of the stabilizing surfaces 49, 50. Transition surfaces 81, 87 are provided to ease contact between stabilizing surfaces 49, 50 and to avoid sharp corners where stress may concentrate.

A rib 82 is provided upstanding on the inner face 83 of leg 74 in an axial orientation for receipt within groove 26 (FIGS. 1, 3 and 6-8). Rib 82 includes rails 27 that cooperate with rails 24; i.e., rails 27 are received between lip 12 and holding surfaces 25 of rails 24 to support wear member 3 under certain loads. While rib 82 with rails 84 preferably has a T-shaped configuration, other shapes, such as dovetail, could be used. Alternatively, there could be no rails in certain situations such as low load environments. Rib 82 preferably extends over at least half of leg 22, and most preferably over substantially the entire length of inner surface 83, for receipt within groove 26 to maximize the support available. Alternatively, the groove could be formed on wear member 3 and the rib on base 5. When shroud 3 is installed, it is slid over base 5 and lip 12 such that inside and outside legs 72, 74 straddle base 5 and lip 12. Rib 82 is slid into the open front end 75 of groove 26 in an easy to use manner so that rails 27 cooperate with rails 24 to hold leg 22 to lip 12.

In a preferred construction, rib 82 extends beyond the rear end of leg 74 to define a support 33 that is received in opening 31 beneath brace 30, although other kinds of rearward supports could be used. For example, support 33 could be forward of the rear end of leg 74 provided it included a holding surface 95 free of the leg and facing away from the lip to engage a complementary support surface (like 94) of leg 74. Support 33 is held between a support surface 94 and lip 12 for enhanced support of the wear member 3. The cooperation of support 33 and brace 30 supplements the resistance provided by rails 24, 27. By providing such a support at the rear end of leg 22, bending of the legs can be reduced, which in turn, lessens the risk of breaking the part. For example, as upward vertical loads are applied to front portion 66, shroud 3 tends to shift clockwise around front digging edge 17. This shifting causes outer leg 22 to pull away from outer wall 16 of lip 12. This action of pulling away from wall 16 places a large amount of stress in inside leg 72 which tends to resist the shifting. While this bending is resisted by rails 24, 27, pulling can still generate heavy loading of the leg. By including a support 33 at the rear end of leg 22, the stresses produced in the leg pulling outward under load are substantially reduced, thus, lowering the risk of breakage under heavy loads. As an alternative construction, particularly in low load environments, rails 24, 27 can be omitted so as to rely solely on support 33 in pocket 31. As alternatives, the rear end of the entire outer leg 74 could be received under brace 30, or other supports, and not as extensions of rib 82.

Figure 11:
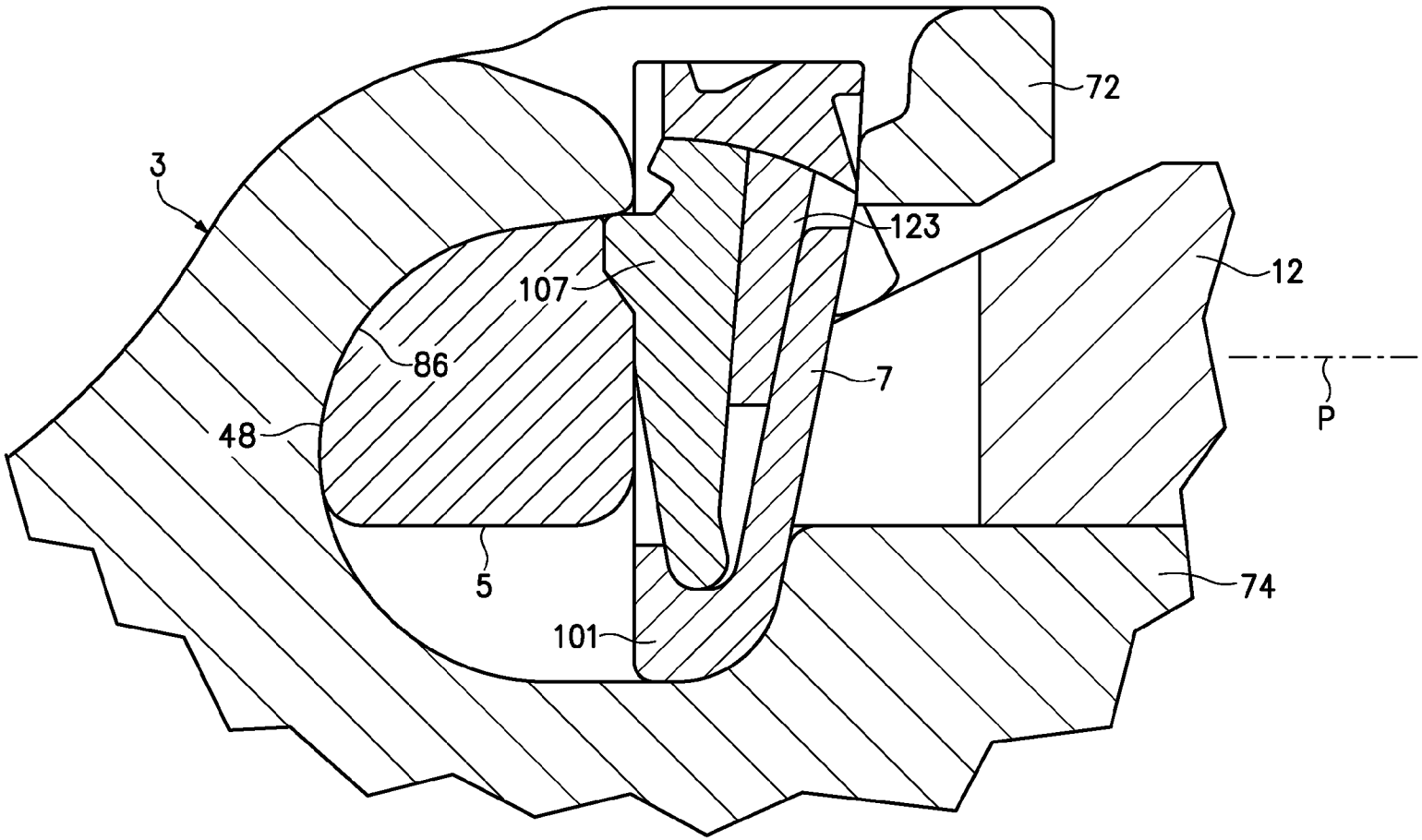
FIG. 11 is a partial cross-sectional view of the wear assembly of the invention.

Wear member 3 is assembled over base 5 with a direct, continuous rearward sliding motion where rib 82 is slid through open end 75 and into groove 26. The rearward movement of wear member 3 over base 5 is continued until inside corner surface 86 abuts front face 48 of base 5 (FIGS. 3 and 11). At this juncture, rear wall 35 of outside leg 74 is preferably placed in close proximity to stop surface 34. With cast parts, it is not practical for inside corner surface 86 and rear wall 35 to simultaneously abut front face 48 and stop surface 34, respectively. However, by placing rear wall 35 in close proximity with stop surface 34, the two surfaces will typically abut under certain loads and after a period of time as wear develops in the parts. While it is not preferred, stop surface 34 could be the primary bearing surface that first abuts rear wall 35, with inside corner surface 86 abutting front face 48 second.

Figure 9:
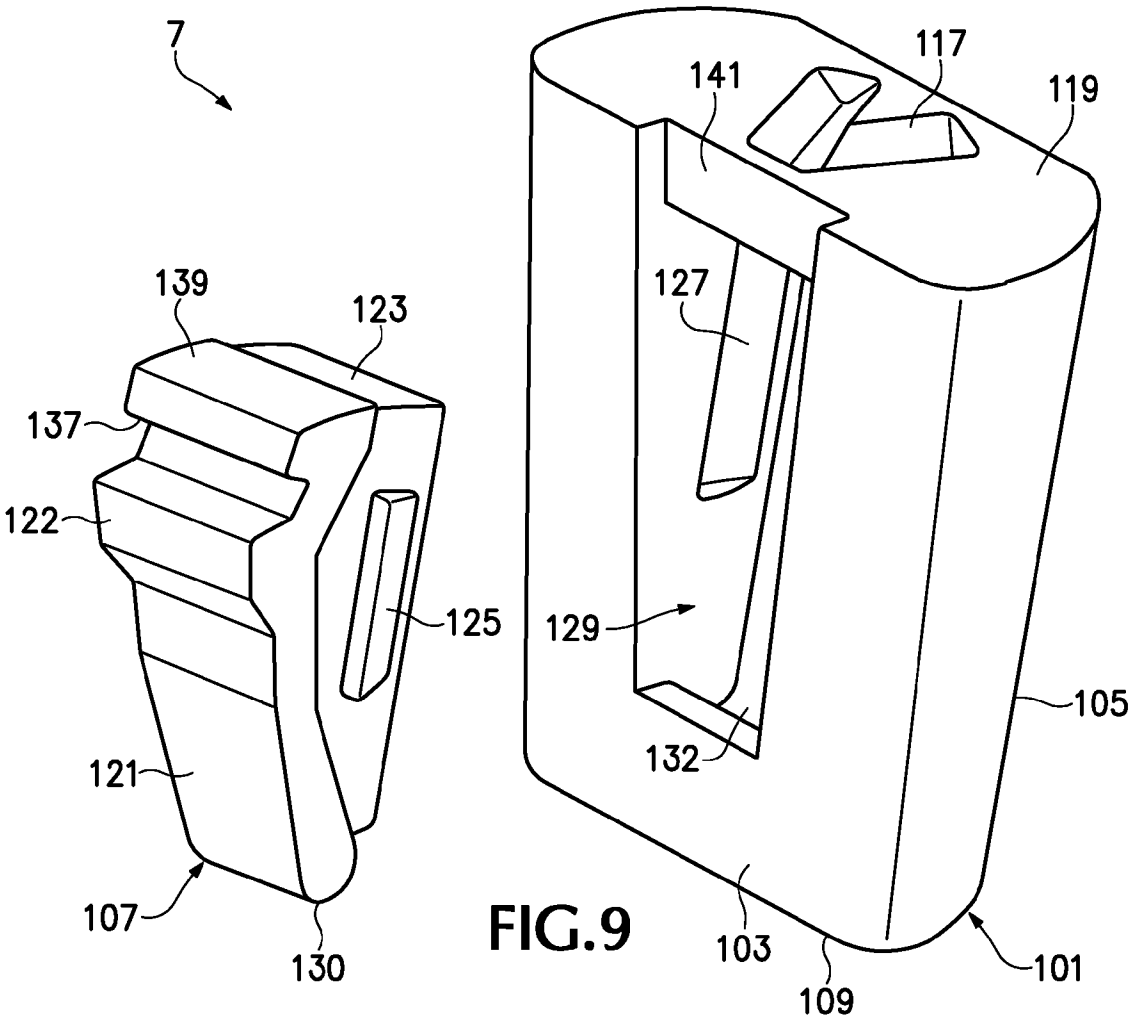
FIG. 9 is an exploded front perspective view of a lock of the wear assembly.
Figure 10:
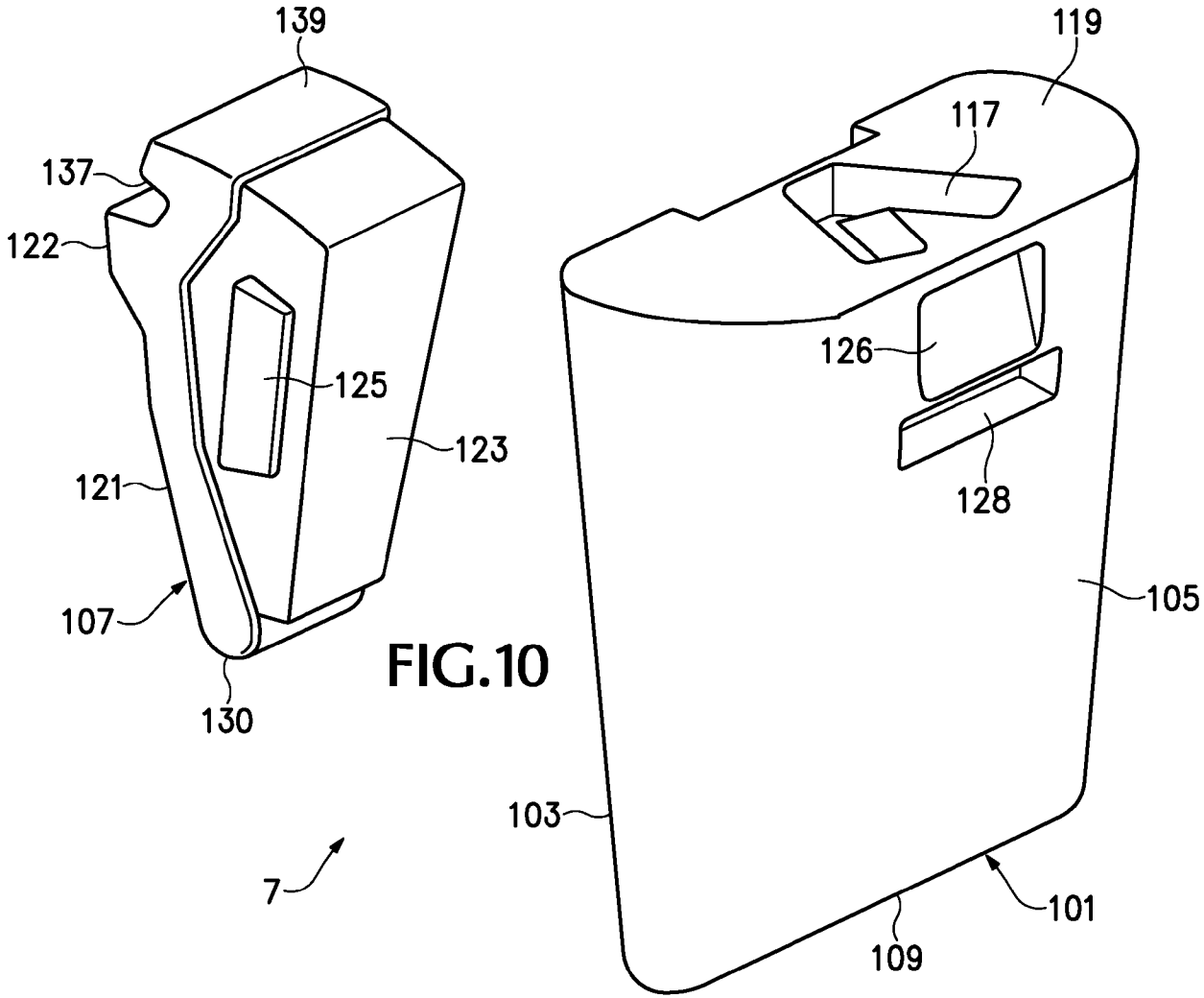
FIG. 10 is an exploded rear perspective view of the lock.

Inside leg 72 of wear member 3 includes a hole 96 adapted to receive lock 7 (FIGS. 6-8 and 11). Lock 7 includes a body 101 with a front face 103 and a rear face 105, and a movable latch 107 (FIGS. 9 and 10). In use, lock 7 is inserted into hole 96 such that front face 103 opposes a rearwardly facing abutting wall 111 in recess 51, and rear face 105 opposes rear wall 113 in hole 96 and front wall 115 of rib 82 (FIGS. 1 and 3). Although the use of rib 82 to form front wall 115 is preferred, this wall could be formed by another projection or by an opening in leg 22. When inserted, lock 7 passes through opening 96, scallop 18, and groove 26. In this position, lock 7 bars the removal of wear member 3 from lip 12. As an alternative, base 5 and wear member 3 could extend forward farther than shown to permit insertion of lock 7 without scallop 18.

In a preferred construction, front and rear faces 103, 105 converge toward each other as they extend toward the bottom or insertion end 109 (FIGS. 9 and 10). Likewise, the collective surfaces of walls 113, 115 preferably coverage toward abutting wall 111. In this way, the lock can be pried into and out of the assembly 1. Latch 107 includes a rigid part 121 preferably composed of steel provided with a locking projection 122, and a resilient part 123 preferably formed of foam, rubber or other elastomer. The bottom end of rigid part 121 defines a fulcrum 130 to fit within recess 132 to form a pivot axis about which latch 107 moves. The resilient part preferably includes detents 125 for receipt within matching grooves 127 in body 101 to retain the latch in cavity 129, but could be secured by other means.

During insertion of lock 7, latch 107 is pressed rearward against the bias of resilient part 123 by its engagement against wear member 3. A curved slope 131 eases the latch rearward into cavity 129 during insertion. Once locking projection 122 clears stop 133, the resilient part 123 biases rigid part 121 outward such that projection 122 engages beneath stop 133 to retain lock 7 in wear assembly 10. To remove lock 7, a pry tool is inserted along the curved slope 131 to retract latch 107 into cavity 129 until stop 133 is released. The pry tool can, through engagement with ledge 137 of latch 107, pull lock 7 from passage 54. When latch 107 is retracted, the top face 139 of rigid part 121 abuts top wall 141 of cavity 129 to enable the lock to be pried out through engagement with the latch. Pry slot 126 is also preferably formed on rear face 105 to engage either a second pry tool or an alternative pry location to help remove lock 7 from passage 54. A hole 128 in the back of the lock allows rock fines to be pushed out of cavity 129. A notch 117 is formed on top wall 119 to accommodate the receipt of a pry too during installation. Other means for inserting or removing the locks, or the use of other locks are possible.

Figure 17:
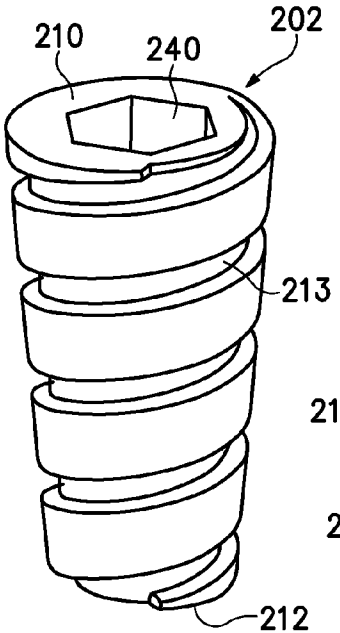
FIG. 17 is a perspective view of a threaded wedge for use in the alternative lock.

An alternative lock 200 can be used to secure wear member 3 to lip 12 (FIGS. 12-18). In general, lock 200 uses a threaded wedge 202 such as disclosed in U.S. Pat. No. 7,171,771, incorporated herein by reference, instead of the elastomer as used in lock 7. Threaded wedge 202 has a rounded exterior 208 that tapers from the trailing end 210 to the leading end 212 (FIG. 17). A helical groove 213 preferably extends the entire length of the wedge, though some portions of the wedge could remain unthreaded. A tool-engaging formation 214 for receiving a wrench or other tool is defined in trailing end 210 for turning of the wedge.

Figure 14:
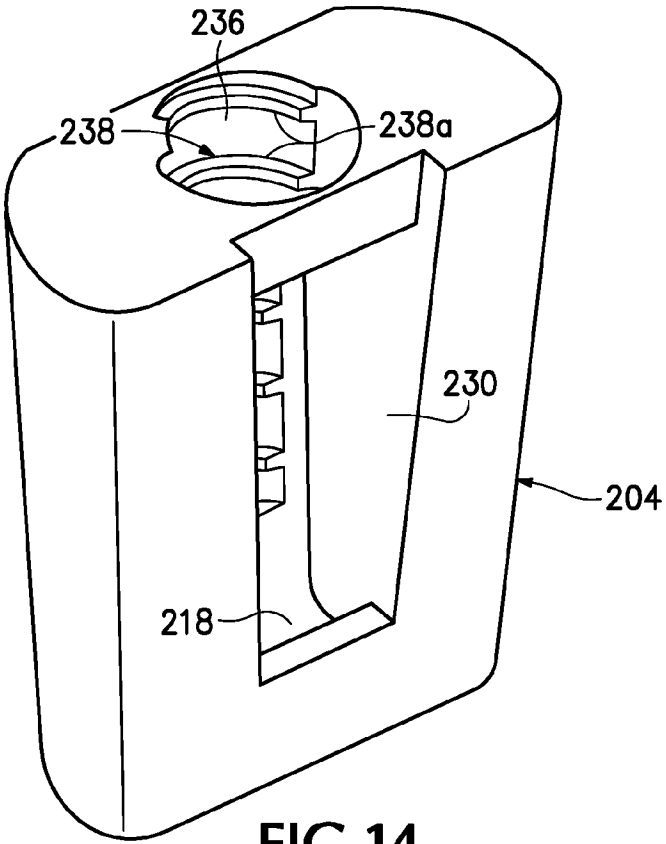
FIG. 14 is a perspective view of a body of the alternative lock.
Figure 13:
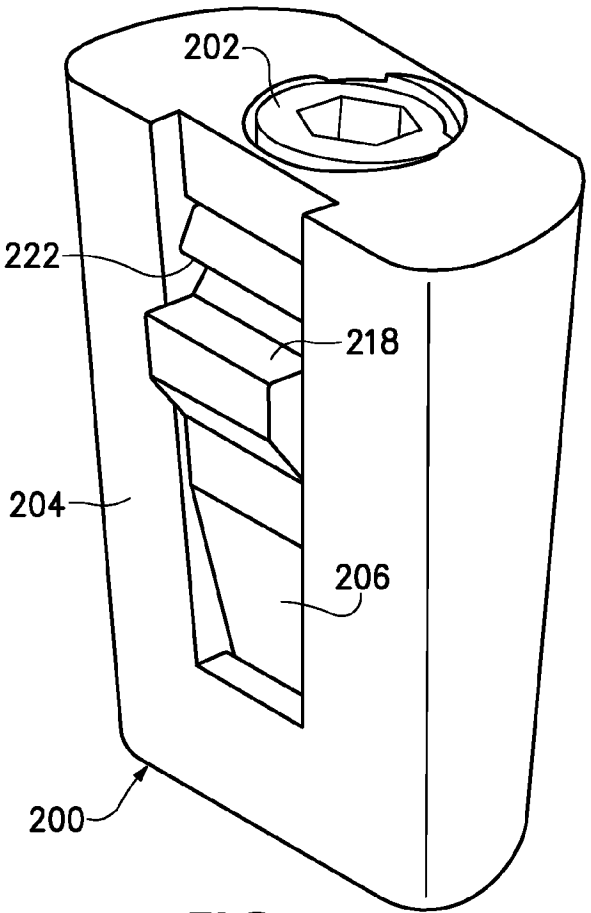
FIG. 13 is a perspective view of the alternative lock.

Lock 200 also includes a body 204 and a latch 206 that are similar to the body and latch in lock 7 (FIGS. 12-16). Body 204 is formed with a channel 230 that receives latch 206 and threaded wedge 202 (FIG. 14). A hole 232 is formed in top side 234 to define an inlet end for receiving threaded wedge 202 into channel 230. A trough 236 with threads 238 in the form of at least one helical ridge segment and preferably a plurality of helical ridge segments 238*a* is preferably provided along the rear wall 239 of channel 230 to engage the helical groove 213 on threaded wedge 202. A recess 218 is formed at the bottom of channel 208 to receive and form a pivot support for fulcrum 220 of latch 206.

Figure 12:
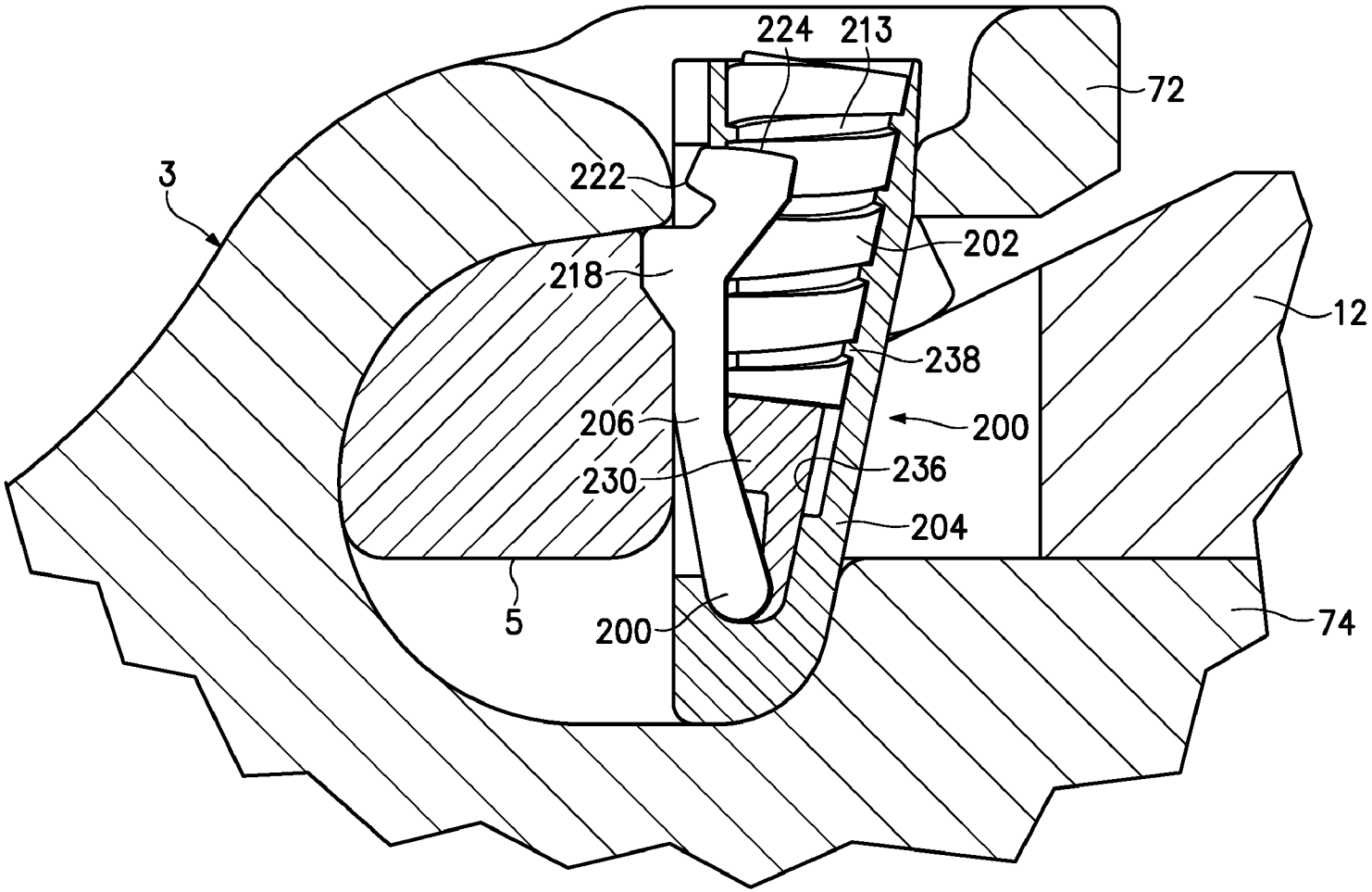
FIG. 12 is a partial cross-sectional view of the wear assembly with an alternative lock.
Figure 18:
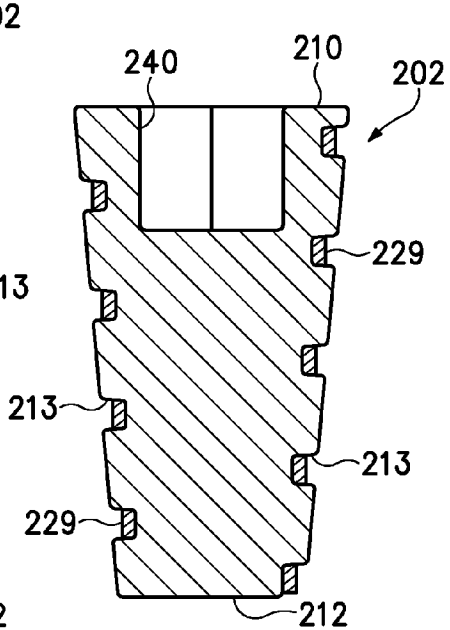
FIG. 18 is a cross-sectional view of the alternative threaded wedge.
Figure 16:
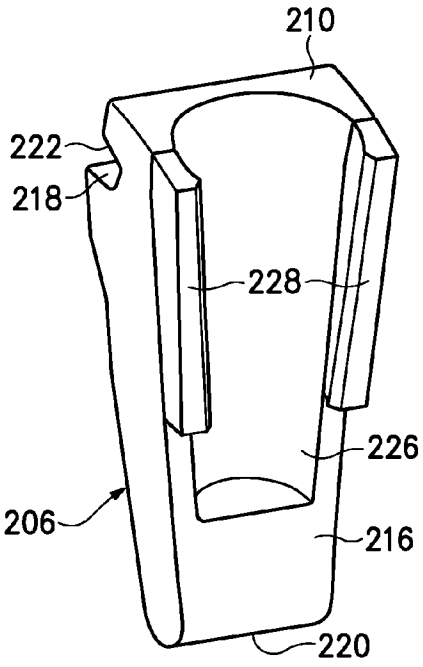
FIGS. 15 and 16 are perspective views of a latch included in the alternative lock.
Figure 15:
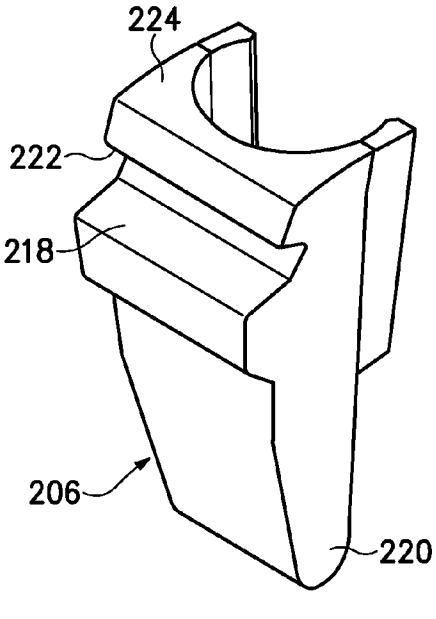

Except for rear side 216, latch 206 has essentially the same construction and function as latch 107; i.e. latch 206 has a locking projection 218, a fulcrum 220, a ledge 222 and a top face 224 (FIGS. 12, 15 and 16). However, unlike latch 107, rear side 216 includes a recess 226 adapted to receive a front portion of threaded wedge 202 (FIG. 16). Retainers, preferably in the form of elastomeric brakes 228 or the like, may be optionally provided to press against wedge 202 and resist its loosening during use. As another alternative, a resilient material 229 may optionally be provided within helical groove 213 of threaded wedge 202 to engage ridges 238 and thereby resist loosening of the wedge (FIG. 18). The resilient material 229 is preferably a strip of rubber, foam, or other elastomer which is fixed within helical groove 213 by an adhesive. The resilient strip 229 preferably extends the entire length of groove 213, but could be formed only along part of the groove. The resilient strip 229 could be used alone or in combination with brakes 228. The threaded wedge 202 with resilient strip 229 can also be used in other wear assemblies such as disclosed in U.S. Pat. Nos. 6,986,216 and 7,174,661 and U.S. patent application Ser. No. 11/818,483, filed Jun. 13, 2007, which are all hereby incorporated by reference.

In use, lock 200 is inserted into assembly 1 like lock 7 (FIG. 12). Lock 200 is preferably inserted into wear assembly 1 with threaded wedge 202 partially inserted into channel 230, but the wedge could be installed after body 204 is placed into the assembly. Threaded wedge 202 is then threaded farther into channel 230 to force latch 206 forward so that locking projection 218 engages stop 133 to retain lock 200 in the assembly during use. A tool-engaging formation 240 is preferably provided at trailing end 210 of wedge 202 to facilitate its turning.

The invention claimed is:

1. A wear assembly for a lip of an excavating bucket comprising a base fixed to the lip and including a first bearing surface, a wear member including a front working portion and a rear mounting portion, the rear mounting portion including a second bearing surface, and a lock to be received between the first and second bearing surfaces to secure the wear member to the lip, the lock including a body having a passage with an open inlet end, a latch attached to the body for movement between a holding position and a release position, and a wedge having a leading end and a trailing end, the passage including a first thread formation and the wedge including a second thread formation that engages the first thread formation, the wedge tapering toward the leading end and being movably received into the passage of the body through the inlet end, the wedge engaging the latch to move the latch from the release position to the holding position as the leading end of the wedge is moved farther into the passage away from the inlet end, and the wedge being rotated to move the wedge in the passage.

2. A wear assembly in accordance with claim 1 wherein the second thread formation is formed by a helical groove on the wedge.

3. A wear assembly in accordance with claim 2 wherein a resilient material is provided within the helical groove to engage the first thread formation and resist loosening of the wedge.

4. A wear assembly in accordance with claim 1 wherein the trailing end of the wedge includes a tool-engaging formation for engaging a tool to rotate the wedge.

5. A wear assembly in accordance with claim 1 wherein the latch is pivotally secured to the body.

6. A wear assembly in accordance with claim 5 wherein the latch includes a resilient retainer that engages the wedge to resist loosening of the wedge.

7. A lock for securing a wear member to excavating equipment comprising a body including a passage with an open inlet end, a latch attached to the body for movement between a holding position and a release position, and a wedge having a leading end and a trailing end, the passage including a first thread formation and the wedge including a second thread formation that engages the first thread formation, the wedge tapering toward the leading end and being movably received into the passage of the body through the inlet end, the wedge engaging the latch to move the latch from the release position to the holding position as the leading end of the wedge is moved farther into the passage away from the inlet end, and the wedge being rotated to move the wedge in the passage.

8. A lock in accordance with claim 7 wherein the second thread formation if formed by a helical groove on the wedge.

9. A lock in accordance with claim 8 wherein a resilient material is provided within the helical groove to engage the first thread formation and resist loosening of the wedge.

10. A lock in accordance with claim 7 wherein the trailing end of the wedge includes a tool-engaging formation for engaging a tool to rotate the wedge.

11. A lock in accordance with claim 7 wherein the latch is pivotally secured to the body.

12. A lock in accordance with claim 11 wherein the latch includes a resilient retainer that engages the wedge to resist loosening of the wedge.

13. A lock for securing a wear member to excavating equipment comprising:

a body including a passage with an open inlet end and at least one helical ridge segment;

a wedge axially received into the passage of the body through the inlet end, the wedge having (i) a leading end and a trailing end and tapering toward the leading end, (ii) a helical groove engaging the helical ridge segment in the passage, and (iii) a tool-engaging formation for rotating the wedge in the passage to axially move the wedge in the passage by the engagement of the groove and the ridge; and a latch pivotally attached to the body for movement between a holding position and a release position, the latch having a front surface with a projection for engaging a stop on the wear member to hold the lock in place during use and a rear surface to engage the wedge and be pressed by the wedge into the holding position.

14. A lock in accordance with claim 13 wherein the wedge further includes a resilient material in the helical groove to engage the helical ridge segment and resist loosening of the wedge.

15. A lock in accordance with claim 13 wherein the latch includes a resilient retainer that engages the wedge to resist loosening of the wedge.

16. A lock in accordance with claim 13 wherein the rear surface of the latch includes a recess into which the wedge is received.

* * * * *